United States Patent [19]

Rave

[11] 4,035,229

[45] July 12, 1977

[54] PAPER STRENGTHENED WITH GLYOXAL MODIFIED POLY(β-ALANINE) RESINS

[75] Inventor: Terence W. Rave, Wilmington, Del.

[73] Assignee: Hercules Incorporated, Wilmington, Del.

[21] Appl. No.: 653,188

[22] Filed: Jan. 28, 1976

Related U.S. Application Data

[62] Division of Ser. No. 521,002, Nov. 4, 1974, abandoned.

[51] Int. Cl.[2] ..... D21H 3/52; D21H 3/58

[52] U.S. Cl. ..... 162/164 EP; 162/166; 162/167; 162/168 NA

[58] Field of Search ..... 162/166, 167, 168 NA, 162/164 EP; 260/72 R, 72 N; 8/184

[56] References Cited

U.S. PATENT DOCUMENTS

| | | | |
|---|---|---|---|
| 2,719,798 | 10/1955 | Wooding et al. | 428/527 |
| 2,749,331 | 6/1956 | Breslow | 260/72 R |
| 3,853,816 | 12/1974 | Williams et al. | 162/167 |

*Primary Examiner*—S. Leon Bashore
*Assistant Examiner*—William F. Smith
*Attorney, Agent, or Firm*—Marion C. Staves

[57] ABSTRACT

Novel resins, useful as strengthening resins for imparting dry and temporary wet strength to paper, are disclosed. The resins are prepared by reacting branched water-soluble poly(β-alanine) with glyoxal.

6 Claims, No Drawings

PAPER STRENGTHENED WITH GLYOXAL MODIFIED POLY(β-ALANINE) RESINS

This is a division of application Ser. No. 521,002, filed Nov. 4, 1974, now abandoned.

This invention relates to novel resins which impart dry strength and temporary wet strength to paper, the process of incorporating them into paper and the paper so treated.

It is known to add certain resins to paper, usually during the paper-making process, to improve wet and/or dry strength of paper. The type of resin added depends on the properties desired in the final paper product. For tissue, towelling and certain other applications, it is desirable that the strengthening resin added to the paper impart dry and temporary wet strength.

Numerous resins are known in the art that will achieve these results. For example, U.S. Pat. Nos. 3,607,622, 3,728,214 and 3,778,215 to Espy relate to resins which impart both dry strength and temporary wet strength to paper. The resins of Espy are prepared by reacting certain polyamines and aminopolyamides with an acrylamide and then with a polyaldehyde. Also, U.S. Pat. No. 3,556,932 to Coscia et al. teaches wet and dry strength resins which are ionic water-soluble vinylamide polymers having glyoxal-reactive amide substituents and sufficient —CHOHCHO substituents to be thermosetting. The polymers are produced by reacting glyoxal with vinylamide polymers, such as ionic copolymers of acrylamide with monomers which will impart ionic properties to the polymer, e.g., diallyldimethyl ammonium chloride and 2-methyl-5-vinylpyridine. The vinylamide polymers are produced under conditions which result in addition polymerization of acrylamide through the double bond of the vinyl group. After modification with glyoxal, there is produced a polymer composed of units having the formula

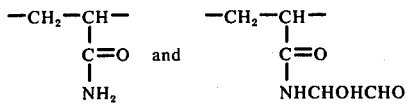

While these resins do impart dry and temporary wet strength to paper, they have the disadvantage of a relatively short shelf life when stored in aqueous solution at concentrations at which they are generally used during the paper-making process.

In accordance with this invention, it has been found that glyoxal modified poly(β-alanine) resins are effective dry strength and temporary wet strength resins for papers. The novel resins of this invention are stable in aqueous solution at relatively high solids concentration and have a long shelf life. Accordingly, the present invention relates to novel resins prepared by a. polymerizing acrylamide in the presence of a basic catalyst and a free-radical inhibitor to produce branched water-soluble poly(β-alanine);
b. dissolving the poly(β-alanine) in water to provide an aqueous solution having a solids content of about 11 to about 40%; and
c. adding glyoxal in the amount of about 10 to about 100 mole %, based on the amide repeating units of the poly(β-alanine), thus producing a glyoxal-modified poly(β-alanine).

The poly(β-alanine) used in preparing the novel resins of this invention is a branched, water-soluble, poly(β-alanine) prepared by the anionic polymerization of acrylamide in the presence of a basic catalyst and a vinyl polymerization inhibitor. Anionic polymerization of acrylamide results in a polymer backbone of β-alanine repeating units. The preparation of linear crystalline poly(β-alanine) by the anionic polymerization of acrylamide is described in U.S. Pat. No. 2,749,331 to Breslow. Water-soluble and water-insoluble forms of the polymer are obtained. In later work it was determined that the water-soluble form of poly(β-alanine) can be either a linear crystalline polymer of relatively low molecular weight or a higher molecular weight polymer having a branched structure. Branched, poly(β-alanine) contains repeating units of the formula $\sim CH_2CH_2CONH\sim$ in the linear segments and repeating units of the formula

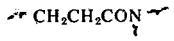

in the segments at which branching occurs. Primary amide end groups will occur at the end of each branch chain. Hydrolysis of water-soluble branched poly(β-alanine) produces β-alanine, $NH_2CH_2CH_2COOH$, from the linear segments, iminodipropionic acid, $HN(CH_2CH_2COOH)_2$ from the points of branching and ammonia from the primary amide end groups.

This provides a basis for measuring the degree of branching present in a given sample of poly(β-alanine). On hydrolysis of the sample the ammonia and/or iminodipropionic acid produced can be measured, thus providing a determination of the degree of branching. The amount of ammonia liberated indicates the number of primary amide groups and since such groups are present only as end groups of the branch chains, an indication of the amount of branching of the poly(β-alanine) can be determined. Any poly(β-alanine) containing sufficient branching to be water-soluble is suitable for use in this invention. In general, the branched poly(β-alanine) should contain about one primary amide group for every two to six amide groups present. The molecular weight of branched water-soluble poly(β-alanine) suitable for use in this invention is in the range of about 500 to about 10,000 and preferably in the range of about 2,000 to about 6,000.

As stated above, the branched water-soluble poly(β-alanine) is prepared by the anionic polymerization of acrylamide in the presence of a basic catalyst and a vinyl or free-radical polymerization inhibitor. Because of the extremely exothermic nature of the anionic polymerization, it is preferred to conduct the reaction in a suitable organic reaction medium inert to the reaction conditions and capable of dissolving or slurrying acrylamide. Suitable media include aromatic and aliphatic compounds, for example, toluene, xylene, tetrahydronaphthalene, chlorobenzene, nitrobenzene and dioxane.

The concentration of the acrylamide monomer in the reaction medium is in the range of about 2 to about 30%, and is preferably about 8 to about 15%.

If desired, an organo-soluble polymeric dispersing agent can be added to the reaction mixture prior to the addition of the basic catalyst. When the dispersing agent is employed, the poly(β-alanine) produced is in powdered or bead form, easily filterable from the reaction medium. Suitable dispersing agents are styrene-butadiene copolymers, polyisoprene, chlorinated polypropylene, chlorinated and maleated polyisoprene, and chlorinated and maleated polyolefins.

Illustrative basic catalyst which can be employed include alkali metals, alkali metal hydroxides, alkaline earth metal hydroxides, quaternary ammonium hydroxides and the corresponding alkoxides, Examples of suitable basic catalysts are sodium metal, sodium hydroxide, lithium hydroxide, potassium hydroxide, sodium t-butoxide, sodium methoxide, tetramethylammonium hydroxide, potassium t-butoxide, and calcium hydroxide. The amount of catalyst used is in the range of about 0.01 to about 2.0 mole % preferably about 0.1 to about 1.5 mole % based on the monomer.

A free radical inhibitor is added to the reaction mixture to inhibit vinyl polymerization through the double bond of the acrylamide monomer. Examples of free radical inhibitors which can be used are phenyl-β-naphthylamine hydroquinone, diphenylamine, and phenothiazine.

The anionic polymerization reaction is conducted at temperatures in the range of about 40° to about 140° C. and preferably about 80° to about 130° C.

In many cases, the anionic polymerization of acrylamide under the above conditions will produce a mixture of water-soluble and water-insoluble poly(β-alanine). The water-soluble polymer for use in this invention can be readily separated by partially dissolving the polymer product in water and removing the insoluble fraction by conventional methods such as filtration, etc.

Poly(β-alanine) is a neutral polymer. For most, although not all, methods of applying strengthening resins to paper, the resin should be ionic for efficient retention by the pulp. For this reason in preparing the resins of this invention, it is desirable to modify the branched, water-soluble poly(β-alanine) before reaction with glyoxal to introduce anionic or cationic groups into the polymer structure. However, if the strengthening resin is to be used in a manner in which the resin does not need to be ionic, for example, surface application to the formed paper sheet, then ionic modification of poly(β-alanine) prior to reaction with glyoxal is not necessary.

Anionic modification of branched poly(β-alanine) can be accomplished by partial hydrolysis of the polymer to convert some of the primary amide groups into anionic carboxyl groups. For example, hydrolysis of poly(β-alanine) can take place by heating a slightly basic aqueous solution of the polymer having a pH of about 9–10 at temperatures of about 50° to about 100° C. The amount of anionic groups introduced should be about 1 to about 10 mole % and preferably about 2 to about 5 mole %, based on amide repeating units.

Another method of anionic modification of branched poly(β-alanine) is by treatment with formaldehyde and then with bisulfite ion.

Cationic modification of branched poly(β-alanine) is accomplished by reactive poly(β-alanine) in aqueous solution with formaldehyde and dimethylamine. This reaction can be carried out by heating an aqueous solution of the three reactants at about 70° to about 80° C. at either a basic pH of about 9 to about 11 or an acid pH of about 2 to about 4. This reaction introduces tertiary amine end groups into the polymer. When the pH of the resulting aqueous solution is adjusted to use conditions, i.e., about 4.5 to about 8.0, the tertiary amine groups are protonated and are thus rendered cationic. The amount of formaldehyde and dimethylamine used is from about 2 to about 15 mole%, based on amide repeating units of the poly(β-alanine). The amount of cationic groups introduced is from about 2 to about 15 mole % and preferably from about 4 to about 8 mole %, based on amide repeating units.

The final step in preparing the novel resins of this invention is the reaction of poly(β-alanine) with glyoxal. As stated above, poly(β-alanine) can be modified to introduce anionic or cationic groups, as desired, before reaction with glyoxal. Reaction of poly(β-alanine) and glyoxal is carried out in aqueous solution. The solids concentration of poly(β-alanine) in the aqueous solution should be above about 10% and can be from about 11 to about 40% with about 12.5 to about 25% being the preferred range. The amount of glyoxal used in this reaction can be from about 10 to about 100 mole % and is preferably about 20 to about 30 mole %, based on the amide repeating units of the poly(β-alanine). The temperature of the reaction is from about 10° to about 50° C., preferably about 20° C. to about 30° C.

The reaction between the glyoxal and poly(β-alanine) is continued until a viscosity increase of about 2 to about 10, preferably 4–6 viscosity units on the Gardner-Holdt scale has taken place. The viscosity increase indicates that a certain amount of crosslinking of the poly(β-alanine) has taken place. The amount of crosslinking is insufficient to cause gelation of the poly(β-alanine) solution but is adequate to provide polymeric units of sufficiently high molecular weight to be retained by the cellulose fibers when used as a paper strengthening resin.

The glyoxal modified poly(β-alanine) resins of this invention can be used to impart dry strength and temporary wet strength to paper using any conventional method. Aqueous solutions of the resins may be applied to the formed paper sheet, e.g., by spraying, or tub application, etc. When applied in this manner it is not necessary that the resin be ionic. However, the preferred methods, at the present time, of incorporating these resins into paper involve the addition of dilute aqueous solutions of the resins to an aqueous solution of paper stock prior to sheet formation. For example, the resin solution can be added to the paper stock in the beater, stock chest, Jordon engine, fan pump, head box or any other suitable point. Because of the anionic nature of the cellulose fibers, it is desirable to use an ionic resin so that it will be absorbed on the cellulose fibers. A cationic resin will be adsorbed directly on the cellulose fibers due to the difference in electrostatic charge. When an anionic resin is used it becomes necessary to add a cationic bridging agent to attach the anionic resin to the anionic cellulose fibers. Thus, when an aqueous solution of glyoxal-modified anionic poly(β-alanine) is used in this manner, it is necessary to add a cationic bridging agent. Suitable cationic bridging agents include polymeric cationic retention aids such as aminopolyamide-epichlorohydrin resins, polyethylenimine, resins derived from poly(diallylamine) and poly(dialkylmethylamine), cationic starch and other highly cationic polymers, natural or synthetic.

The amount of glyoxal modified poly(β-alanine) added to the paper to impart dry and temporary wet strength is 0.05 to 2% and usually 0.1 to 1% by weight based on weight of the cellulose fibers.

The following examples will serve to illustrate the invention, parts and percentages being by weight unless otherwise indicated.

EXAMPLE 1

This example illustrates the preparation of typical glyoxal-modified anionic poly(β-alanine) of this invention and its use as a dry and temporary wet strength resin for paper.

Part A

In a 5-liter round-bottomed 3-necked flask equipped with a paddle stirrer, thermometer, and condenser are placed 350 parts dry acrylamide, 1.0 parts phenyl-β-naphthylamine, and 3870 parts chlorobenzene. The mixture is heated to 85°–90° C. with vigorous stirring to melt and partially dissolve the acrylamide. Sodium hydroxide flake (1.0 part) is then added. After an induction period, an exothermic reaction occurs and a polymer separates on the walls of the flask and stirrer. Three more 1.0 part charges of catalyst are added at 30 minute intervals, and the reaction mixture is heated at about 90° C. for one additional hour. The hot chlorobenzene is decanted and the resulting solid, brittle polymer is recovered. The polymer is water-soluble, branched poly(β-alanine).

Part B

A sample of poly(β-alanine) prepared in Part A is dissolved in water containing 2 mole percent sodium hyroxide (based on amide repeat units in the polymer) to provide a solution containing25% poly(β-alanine). The solution is heated at 90°–100° C. for about 30 minutes with steam sparge to remove the ammonia liberated during the hydrolysis reaction. The resulting solution then is cooled and the pH lowered to give a resin containing about 2 mole percent carboxyl groups, as measured by potentiometric titration.

Part C

To a 15% aqueous solution of anionic poly(β-alanine) prepared as in Part B is added 25 mole % (based on amide repeat units) of glyoxal as a 40% aqueous solution. The pH of the resulting solution is maintained at 9–10 at room temperature until a 4–6 unit increase in Gardner viscosity has occurred. Then the solution quickly is diluted with water to 10% total solids and adjusted to pH 5.0 with sulfuric acid. The shelf life of the resulting resin is greater than six months with no loes in efficiency.

Part D

The glyoxal modified anionic poly(β-alanine) prepared in Part C is evaluated as dry and wet strength resins in Rayonier bleached kraft pulp. A 3:1 mixture (dry basis) of aqueous solutions of glyoxal-modified anionic poly(β-alanine) and an aminopolyamide — epichlorohydrin resin (commercially available from Hercules Incorporated under the trademark "Kymene 557") is used as the strengthening resin in the following procedures:

Rayonier bleached kraft pulp is beaten in a cycle heater to a Schopper-Riegler freeness of 750cc. Portions of this pulp, adjusted to a pH of 6.5 with sulfuric acid, are added to the proportioner of a Noble-Wood handsheet forming machine. Samples of the strengthening resin are added to the proportioner in amounts of 0.25%, 0.5% and 1% solids based on pulp solids. The pulp then is formed into handsheets of about 40 pounds per 3,000 square foot basis weight and dried for one minute at a temperature of 100° C. A control handsheet is prepared as above without the addition of a strengthening resin. The resulting handsheets after conditioning at a temperature of 75° F. and 50% relative humidity for over 24 hours are tested for dry strength. The handsheets are also tested for wet strength after soaking in distilled water for 10 seconds and for 2 hours to show the temporary nature of the wet strength. Results are shown in Table 1.

EXAMPLE 2

This example illustrates the preparation of a typical glyoxal-modified cationic poly(β-alanine) of this invention and its use as a dry and wet strength resin for paper.

Part A

In an apparatus similar to that described in Part A of Example 1, are placed 20 parts dry acrylamide, 35 parts toluene, and a trace of phenyl-β-naphthylamine. Sufficient 0.5 M $K^+$ $\bar{O}$t-Bu in t-BuOH is added to the mixture heated under $N_2$ to 90°–100° C. to cause polymerization to occur as evidenced by a substantial exotherm and formation of solid polymer. The resulting mixture then is heated at 100° C. for 5 hours; the toluene is separated and the solid poly(β-alanine) is dried.

Part B

To a 25% aqueous solution of essentially neutral poly(β-alanine) prepared in Part A is added 7.5 mole % (based on amide repeat units) each of formaldehyde (as an aqueous solution) and dimethylamine hydrochloride. The pH is adjusted to 9.0–9.5 with aqueous sodium hydroxide, and the solution is heated 20 minutes on a steam bath at 70°–80° C. The pH is then readjusted to 6–7. The resulting resin is shown to be cationic by its ability to bias the charge of anionic wood pulp toward electrical neutrality.

Part C

To a 20% solution in water of the cationic poly(β-alanine) prepared in Part B is added 25 mole % glyoxal as a 40% aqueous solution. The pH of the mixture is maintained at 9–10 until a 4–6 unit increase in Gardner viscosity is observed. The total solids level then is brought to 10% by dilution with water, and the pH is adjusted to 4.5–5.0 The stability of the resulting resin toward gelation is greater than 6 months.

Part D

The glyoxal-modified cationic poly(β-alanine) prepared in Part C of this example is evaluated as a dry and wet strength resin using the procedure described in Example 1. An aqueous solution of this resin is used as the sole strengthening resin. Results are shown in Table 1.

Table 1

Evaluation of Glyoxal Modified Poly(β-alanine) Resins as Paper Additives

| Resin | Percent Added, Based on Pulp (Dry Basis) | Dry Tensile Strength (lb/1" width) | Wet Tensile Strength[1] (lb/1" width) 10 sec.[2] | 2 hr.[3] |
|---|---|---|---|---|
| None | — | 16.8 | 0.5 | 0.4 |
| Example 1 | 0.25 | 19.9 | 2.3 | 1.5 |
| " | 0.50 | 21.8 | 3.9 | 1.9 |
| " | 1.00 | 24.1 | 5.5 | 3.2 |
| Example 2 | 0.25 | 19.5 | 2.0 | 0.8 |
| " | 0.50 | 20.1 | 2.5 | 1.3 |

Table 1-continued

| Evaluation of Glyoxal Modified Poly(β-alanine) Resins as Paper Additives | | | | |
|---|---|---|---|---|
| Resin | Percent Added, Based on Pulp (Dry Basis) | Dry Tensile Strength (lb/1" width) | Wet Tensile Strength[1] (lb/1" width) 10 sec.[2] | 2 hr.[3] |
| " | 1.00 | 19.3 | 3.8 | 1.4 |

[1]Corrected to 40 lb/ream basis weight
[2]Obtained after soaking 10 sec. in water
[3]Obtained after soaking 2 hr. in water

What I claim and desire to be protected by Letters Patent is:

1. The process of treating paper which comprises treating the cellulose fibers of said paper with from 0.05 to 2% by weight, based on the weight of the cellulose fibers of a water-soluble dry strength and temporary wet strength resin in aqueous solution, said resin comprising the reaction product of a branched, water-soluble poly (β-alanine) having a molecular weight in the range of about 500 to about 10,000 with from about 10 to about 100 mole %, based on the amide repeating units of the poly(β-alanine) of glyoxal, said poly(β-alanine) having been prepared by the anionic polymerization of acrylamide in a suitable organic reaction medium inert to the reaction conditions in the presence of a basic catalyst.

2. The process of treating paper which comprises treating the cellulose fibers of said paper with from 0.05 to 2% by dry weight based on the weight of the cellulose fibers of a mixture of (1) an aqueous solution of an anionic water-soluble dry strength and temporary wet strength resin comprising the reaction product of a partially hydrolyzed branched water-soluble poly(β-alanine) having a molecular weight in the range of about 500 to about 10,000 with from about 10 to about 100 mole %, based on the amide repeating units of the poly(β-alanine) of glyoxal, said polyβ-alanine having been prepared by the anionic polymerization of acrylamide in a suitable organic reaction medium inert to the reaction conditions, in the presence of a basic catalyst and partially hydrolyzed to introduce from about 1 to about 10 mole % of anionic groups, based on amide repeating units, and (2) an aqueous solution of a polyamine-polyamide-epichlorohydrin resin.

3. The process of treating paper which comprises treating the cellulose fibers of said paper with from 0.05 to 2% by weight based on the weight of the cellulose fibers of a cationic water-soluble dry strength and temporary wet strength resin in aqueous solution said resin comprising the reaction product of a cationic, branched, water-soluble poly(β-alanine) having a molecular weight in the range of from about 500 to about 10,000 with from about 10 to about 100 mole %, based on the amide repeating units of the poly(β-alanine) of glyoxal, wherein said cationic, branched, water-soluble poly(β-alanine) was produced by the anionic polymerization of acrylamide in a suitable organic reaction medium inert to the reaction conditions in the presence of a basic catalyst and the reaction of the polymerized acrylamide with sufficient dimethylamine and formaldehyde to introduce from about 2 to about 15 mole % of cationic groups, based on amide repeating units.

4. Paper treated with from 0.05 to 2% by weight, based on the weight of the cellulose fibers of the paper, of a water-soluble dry strength and temporary wet strength resin, said resin comprising the reaction product of a branched water-soluble poly(β-alanine) having a molecular weight in the range of about 500 to about 10,000 with from about 10 to about 100 mole %, based on the amide repeating units of the poly(β-alanine) of glyoxal, said poly(β-alanine) having been prepared by the anionic polymerization of acrylamide in a suitable organic reaction medium inert to the reaction conditions in the presence of a basic catalyst.

5. Paper treated with from 0.05 to 2% by weight, based on the weight of the cellulose fibers of the paper, of an anionic water-soluble dry strength and temporary wet strength resin, said resin comprising the reaction product of a partially hydrolyzed branched water-soluble poly(β-alanine) having a molecular weight in the range of about 500 to about 10,000 with from about 10 to about 100 mole %, based on the amide repeating units of the poly(β-alanine) of a glyoxal, said poly(β-alanine) having been prepared by the anionic polymerization of acrylamide in a suitable organic reaction medium inert to the reaction conditions in the presence of a basic catalyst and partially hydrolyzed to introduce from about 1 to about 10 mole % of anionic groups, based on amide repeating units.

6. Paper treated with from 0.05 to 2% by weight, based on the weight of the cellulose fibers of the paper, of a cationic water-soluble dry strength and temporary wet strength resin, said resin comprising the reaction product of a cationic, branched, water-soluble poly(β-alanine) having a molecular weight in the range of about 500 to about 10,000 with from about 10 to about 100 mole % based on the amide repeating units of the poly(β-alanine) of glyoxal, wherein said cationic, branched, water-soluble poly(β-alanine) was produced by the anionic polymerization of acrylamide in a suitable organic reaction medium inert to the reaction conditions in the presence of a basic catalyst and the reaction of the polymerized acrylamide with sufficient dimethylamine and formaldehyde to introduce from about 2 to about 15 mole % of cationic groups, based on amide repeating units.

* * * * *